US005761158A

United States Patent [19]

Azuma et al.

[11] Patent Number: 5,761,158

[45] Date of Patent: Jun. 2, 1998

[54] SOLAR BATTERY POWERED WATCH

[75] Inventors: Akira Azuma, Tokorozawa; Hisato Hiraishi; Takashi Toida, both of Tokyo, all of Japan

[73] Assignee: Citizen Watch Co., Ltd., Tokyo, Japan

[21] Appl. No.: 793,936

[22] PCT Filed: Sep. 8, 1995

[86] PCT No.: PCT/JP95/01791

§ 371 Date: Mar. 7, 1997

§ 102(e) Date: Mar. 7, 1997

[87] PCT Pub. No.: WO96/07956

PCT Pub. Date: Mar. 14, 1996

[30] Foreign Application Priority Data

| | | | |
|---|---|---|---|
| Sep. 8, 1994 | [JP] | Japan | 6-214524 |
| Sep. 14, 1994 | [JP] | Japan | 6-219827 |
| Oct. 5, 1994 | [JP] | Japan | 6-240452 |

[51] Int. Cl.[6] ..... G04C 10/00; H01N 6/36

[52] U.S. Cl. ..... 368/205; 368/228; 136/251; 429/111

[58] Field of Search ..... 368/88, 203, 204, 368/205, 223, 228, 232; 136/244, 251; 429/111

[56] References Cited

U.S. PATENT DOCUMENTS

| | | | |
|---|---|---|---|
| 4,234,947 | 11/1980 | Matsumoto | 368/287 |
| 4,261,049 | 4/1981 | Komiyama et al. | 368/88 |
| 4,296,489 | 10/1981 | Mitsui | 368/205 |
| 4,785,436 | 11/1988 | Sase | 368/205 |
| 5,243,578 | 9/1993 | Mathez | 368/88 |
| 5,438,556 | 8/1995 | Dinger et al. | 368/205 |

FOREIGN PATENT DOCUMENTS

| | | |
|---|---|---|
| 0242 088 | 10/1987 | European Pat. Off. . |
| 522 247 | 4/1972 | Switzerland . |

*Primary Examiner*—Vit W. Miska

*Attorney, Agent, or Firm*—Armstrong, Westerman, Hattori, McLeland & Naughton

[57] ABSTRACT

A covering member (4), a solar battery (3) and a hand-operating mechanism-containing movement (2) are housed inside a case (1) which has a front side opening (1*a*), a glass (5) which is provided in the front side opening (1*a*), in the order of these constituents from the face side of the case (1). The solar battery (3) is disposed opposite to the glass (5) at a light receiving surface thereof which is covered with the covering member (4). The covering member (4) can also serve as a dial. If the covering member (4) is molded out of ceramic, it can provide the dial with a white appearance, so that light can sufficiently be transmitted to the receiving surface of the solar battery (3) owing to the light transmittance of the ceramic.

10 Claims, 12 Drawing Sheets

FIG.3

| Sample | Temperature of first sintering | Temperature of second sintering | Temperature of third and fourth sintering | average diameter of ceramic grains | transmittance | transparency |
|---|---|---|---|---|---|---|
| A | 1200℃ | 1500℃ | 1450℃ | 3 μm | 33% | × |
| B | 1500 | 1650 | 1500 | 15 | 47 | × |
| C | 1200 | 1740 | 1500 | 35 | 51 | × |
| D | 1570 | 1740 | 1500 | 45 | 52 | ○ |
| E | 1200 | 1740 | 1570 | 40 | 51 | × |
| F | 1500 | 1670 | 1570 | 25 | 50 | × |
| G | 1570 | 1810 | 1570 | 60 | 53 | ○ |
| H | 1500 | 1700 | 1500 | 35 | 50 | × |
| I | 1200 | 1700 | 1570 | 30 | 51 | × |
| J | 800 | 1570 | 1400 | 8 | 43 | × |
| K | 1200 | 1700 | 1500 | 25 | 50 | × |
| L | 900 | 1530 | 1450 | 5 | 41 | × |
| M | 1500 | 1770 | 1570 | 50 | 52 | ○ |

SOLAR BATTERY POWERED WATCH

TECHNICAL FIELD

This invention relates to a solar battery powered watch provided with a solar battery as a power supply.

BACKGROUND TECHNOLOGY

A solar battery powered watch provided with a solar battery as a power supply has been conventionally generally structured in a manner that the solar battery is mounted on the surface of a dial under a glass so as to be seen from the outside in view of the fact that the solar battery absorbs light to generate electric power.

However in such a structure, since the solar battery has a peculiar deep violet color, colors of the dial and designs of the dial are largely restricted, which makes it difficult to bring out an ornamental value of the watch.

Aiming to solve such a problem, there is proposed an invention having coloring means at a light receiving surface of a solar battery as disclosed, for example, in a publication of JP-A 5-29641.

That is, in the same publication, cholesteric liquid crystal is microcapsuled and the surface of the solar battery is coated with the microcapsuled liquid crystal as a binder.

However, in the coloring means disclosed in the same publication, there are few colors to be selected as those of the dial, and the surface of the dial becomes a deep color, and hence it does not enhance the ornamental value thereof. Particularly, there is a problem that the aforementioned coloring means can not produce white which is a basic color and is frequently used as a color of the dial of the watch.

Under the circumstances, it is an object of this invention to realize a solar battery powered watch capable of designing a dial with free colors including white, and of transmitting light which is sufficiently necessary for generating electric power for the solar battery.

It is another object of this invention to provide a solar battery powered watch capable of improving impact resistance of a covering member.

DISCLOSURE OF THE INVENTION

To achieve the above objects, a solar battery powered watch of this invention comprises a case having an opening on a front side thereof, and a glass covering the opening, a movement having a hand-driving mechanism and housed in the case, a solar battery having a light receiving surface disposed opposite to the glass and installed on a front side of the movement inside the case, and a covering member for covering the light receiving surface of the solar battery.

With such an arrangement, since the surface of the covering member can be seen from the outside through the glass, if the covering member is also used as the dial, it is possible to provide the solar battery powered watch provided with a dial having a desired color if the color of the covering member is adjusted to the desired color.

According, to this invention, the covering member is molded out of ceramic. Since the ceramic in general looks white, it is possible to form white dial (covering member) without coloring the dial.

It is needless to say that the covering member molded out of ceramic can prevent the solar battery from being seen from the outside. Further, since incident light appropriately is transmitted through the ceramic made of a porous material, the solar battery can be charged without a problem.

Since ceramic is easily colored, its color other than white is freely adjustable.

Further, this invention provides a solar battery powered watch having light transmittance so that the solar battery is irradiated with sufficient light, and a preferable structure of the covering member to show a white appearance.

That is, if the covering member is molded out of ceramic containing aluminum as a main constituent, it can show a preferable white, and if an average diameter of the ceramic grains ranges from 5 μm to 40 μm, and the covering member is molded to a thickness ranging from 0.2 m to 0.5 mm, the covering member can keep high external quality and transmit light sufficiently for charging the solar battery.

In case that the covering member its utilized as a dial, dial patterns such as an indicator, lettering for a brand name, and the like are inscribed on the surface of the covering member. As a result, since the light transmittance is prevented by the dial patterns, it is unavoidable that light transmittance area of the covering member is reduced. Further, light returned to the surface of the covering member owing to diffusion of light in the covering member is absorbed by an interface between the covering member and the dial patterns so that the amount of light which reaches the solar battery is further reduced.

Accordingly, it is preferable to form an arbitrary dial patterns on the surface of the covering member and to interpose light reflection layers or light reflection faces between the surface of the covering member and the dial patterns to keep the watch driving stable by minimizing the reduction of the amount of irradiation of light to the solar battery.

In such a structure, light which is incident on the covering member as the dial first enters the inside of the covering member which is light transmittant. The thus entered light is diffused inside the covering member and directed to various directions. As a result, most of the incident light spreads out while it is diffused inside the covering member, and a part of the incident light is returned to the surface of the covering member.

The amount of light which is returned to the surface is substantially uniform on the surface of the covering member. Since the light returned to a part where the dial patterns are formed is reflected on the light reflection layers or light reflection faces, and it is returned to the inside of the covering member, and then it is transmitted to the solar battery, the amount of irradiation of light to the solar battery can be increased.

In the case of the conventional solar battery powered watch having no reflection layer at the interface between the covering member and the dial patterns, the light returned to the part where the dial patterns are formed inside the covering member is all absorbed by the dial patterns. In such a manner, since the light which spreads out while it is diffused inside the dial is absorbed by the dial patterns, and hence the amount of irradiation of light to the solar battery is significantly reduced.

The arrangement of the solar battery powered watch having light reflection layers or light reflection faces can eliminate the loss of light caused by the light absorption at the interface between the covering member and the dial patterns, and can reduce the loss in the amount of irradiation of light.

It may be possible to laminate a transparent substrate to the surface of the covering member, and to form arbitrary patterns on the surface of the transparent substrate, and further light reflection layers or light reflection faces are interposed between the surface of the transparent substrate and the dial patterns. Since the covering member is molded out of ceramic, it has a property that it is fragile and breaks easily when impact loading is applied to the covering member. Particularly, when the covering member is accommodated to move freely in the case, there is good possibility that the covering member strikes strong against a peripheral sidewall of the opening of the case and that it is broken when an impact loading is applied.

Accordingly, it is preferable that the outer rim of the covering member is in contact in advance with the peripheral sidewall of the opening of the case, whereby the movement of the covering member in the case is restricted to prevent the breakage of the covering member.

Further, if at least the outer rim of the covering member is pressed against the peripheral sidewall of the opening of the case by an elastic member, the covering member can be surely brought into contact with the peripheral sidewall of the opening of the case.

In order to carry out the positioning of the covering member utilizable as the dial in the case, it may be possible to dispose a positioning frame around the outer periphery of the covering member, to provide projecting parts or recessed parts in the positioning frame, to provide recessed parts or projecting parts in the covering member for engagement with the projecting parts or recessed parts of the positioning frame, and to provide positioning means for positioning the positioning frame relative to the movement.

With such an arrangement, the covering member can be easily positioned relative to the movement, which becomes a positioning standard relative to respective constituents in the case, by way of the positioning frame.

An ornamental frame may be provided inside the case along the rim of the opening of the case for enhancing the value of the watch as ornamental goods.

In this case, when the inside of the periphery of the covering member is brought into contact with the ornamental frame, the movement of the covering member is restricted inside the case to prevent the breakage of the covering member.

Further, when the positioning projecting parts are provided on the periphery of the covering member, if a gap is defined between the periphery of the covering member and the case, and the projecting parts provided on the periphery of the covering member are disposed in the gap, the projecting parts do not contact the case. Accordingly, even if the covering member receives an impact loading, there is no likelihood of occurrence of stress concentration the projecting parts, so that the tolerance against an impact can be further enhanced.

In the solar battery powered watch which is structured such that the opening formed at the back side of the case is covered by a case back, and the covering member, the solar battery and the movement are held by a casing frame, it is preferable to interpose an intermediate member made of a resin material between the case back and the movement.

As a result, when the solar battery powered watch receives an impact loading, the intermediate member functions to suppress the deformation of the covering member, thereby preventing the breakage of the covering member with more reliability.

If the intermediate member is disposed at a position opposite to the ornamental frame, there is no possibility that a shearing force acts on the covering member which is held between the ornamental frame and the intermediate member, thereby preventing the breakage of the covering member with more reliability.

Further, even if an elastic member is interposed between the case back and the casing frame, the elastic member functions to suppress the deformation of the covering member, thereby preventing the breakage of the covering member with more reliability.

For positioning the covering member relative to the movement, it may be structured such that through holes are defined in the covering member at a region contacting the ornamental frame, and end portions of the fixed pins are engaged in the through holes, and the fixed pins protrude from the underside of the covering member, and through holes are defined in the solar battery for insertion of the fixed pins, and further a means for securely holding the fixed pins is provided on the movement.

BRIEF DESCRIPTION OF THE DRAWINGS

FIG. 3 is a table showing a condition for fabricating the covering member, average diameters of ceramic grains, and results of measurement of transmittance and transparency of each sample.

BEST MODE FOR CARRYING OUT THE INVENTION

A best mode for carrying out this invention will be now described with reference to the attached drawings.

(First Embodiment)

Figure 1:
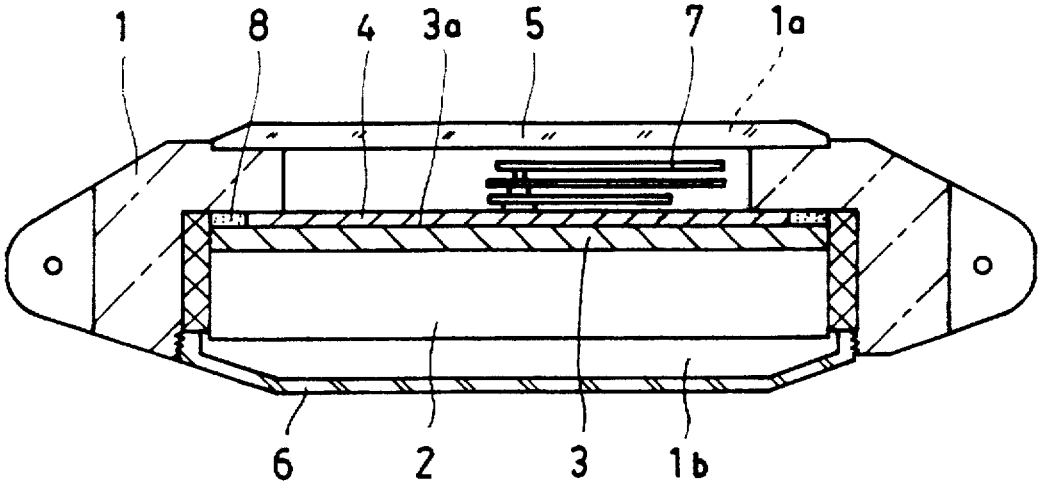
FIG. 1 is a cross sectional view of a solar battery powered watch according to a first embodiment of this invention.
Figure 2:
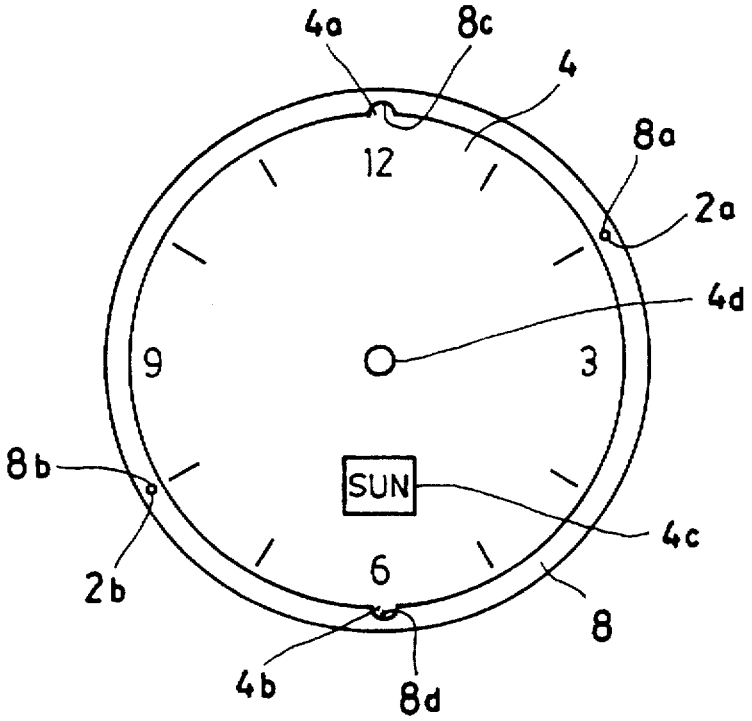
FIG. 2 is a plan view of a covering member which is one of the constituents of the solar battery powered watch of the first embodiment and is used as a dial.

A solar battery powered watch according to a first embodiment of this invention will be now described with reference to FIGS. 1 and 2. FIG. 1 is a cross sectional view of the solar battery powered watch according to the first embodiment of this invention, and FIG. 2 is a plan view of a covering member which is one of the constituents of the solar battery powered watch of the first embodiment and is used as a dial.

As shown in FIG. 1, the solar battery powered watch accommodates a movement 2, a solar battery 3, and a dial 4 in a case 1.

The case 1 has an opening (face side opening) 1*a* at the front side thereof, and another opening (back side opening) 1*b* at the back side thereof. A glass 5 made of transparent glass or sapphire is provided in the face side opening 1*a*. Meanwhile, the back side opening 1*b* can be covered by a case back 6. Respective constituents in the case 1 can be accommodated through the back side opening 1*b*.

Respective constituents in the case 1 are arranged in the order of the dial 4, the solar battery 3 and the movement 2 from the side close to the glass 5, wherein a light receiving surface (front surface) 3*a* of the solar battery 3 is opposed to the glass 5.

The movement 2 houses therein an electric double layer capacitor for storing a generated electric power of the solar battery 3, a crystal oscillator serving as a time base source, a semiconductor integrated circuit for generating driving pulses for driving a hand 7 based on an oscillation frequency of the crystal oscillator, a step motor for driving a train wheel mechanism second by second upon reception of the driving pulses, and the train wheel mechanism, which are respectively not shown.

The dial 4 serves as a covering member for covering the surface of the solar battery 3, described later, so that the solar battery 3 can not be seen from the outside. Dial patterns such as an indicator, lettering for a brand name, and the like are inscribed on the surface of the dial 4 for performing a primary function of the inherent dial 4.

The dial 4 is in advance fixed to the movement 2 by way of a positioning frame 8. That is, as shown in FIG. 2, positioning pins 2*a* and 2*b* are provided on the movement 2 at the front periphery thereof, and the positioning pins 2*a* and 2*b* penetrate the solar battery 3 and protrude from the positioning frame 8 at their arranging portions (front periphery of the solar battery 3). Meanwhile, positioning holes 8*a* and 8*b* are bored in the positioning frame 8. When the positioning pins 2*a* and 2*b* are engaged in the positioning holes 8*a* and 8*b*, the positioning frame 8 can be fixed to the movement 2 at a given relative position thereof.

Further, recessed parts 8*c* and 8*d* are provided on the positioning frame 8 at the inner periphery thereof, while projecting parts 4*a* and 4*b* are provided on the dial 4 at the outer periphery thereof. When the projecting parts 4*a* and 4*b* are engaged, in the recessed parts 8*c* and 8*d*, the dial 4 can be fixed to the positioning frame 8.

The dial (covering member) 4 is formed by molding ceramic containing alumina and zirconia as a main constituent. Particularly, in the first embodiment, the dial 4 is made of ceramic containing alumina as the main constituent. The ceramic made of alumina as the main constituents looks a preferable white, and has high mechanical strength.

If the dial 4 is to be colored, pigment is dispersed in the ceramic or the surface of the dial 4 is colored by coating means so that the dial 4 is easily colored with a desired color.

The solar battery 3 is formed of thin films of non-monocrystalline silicon or films of monocrystalline silicon, or films of compound In the first embodiment, the light receiving surface 3*a* of the solar battery 3 is covered with the dial 4, causing the light receiving surface 3*a* to be unrecognizable from the outside. Accordingly, the peculiar deep violet color of the solar battery 3 can not be seen, and hence the dial 4 looks white which is particular to alumina.

Although it is sufficient that the dial 4 and the solar battery 3 are merely overlapping each other, they can be joint to each other by a transparent adhesive, and the like in an assembling step thereof, if necessary.

A method of fabricating the solar battery 3 will be now described.

First, an insulating film (not shown) is formed on the entire surface of a metallic substrate made of e.g., brass by use of a sputtering system. The insulating film is made of silicon oxide in the thickness of about 100 nm.

Next, an electrode film (not shown) is formed by use of the same sputtering system. The electrode film employs aluminum containing, e.g., 1 wt % of silicon. The electrode film may be formed on the entire surface of the metallic substrate or may be partly formed on the insulating film.

When the electrode film is partly formed on the insulating film, a metal mask is employed. The metal mask is formed of a thin sheet of a metallic material, and has an opening in a region forming the electrode. The metal mask having the opening therein is put on the substrate, and it is arranged in the sputtering system, then the electrode film is formed in the opening of the metal mask.

Subsequently, a solar battery layer (not shown) composed of thin films of non-monocrystalline silicon is formed on the surface of the electrode film. The solar battery layer is composed of, for example, amorphous silicon films (non-monocrystalline silicon films) each having a structure of a p-i-n type conductivity.

The solar battery layer is formed by use of a plasma chemical vapor deposition system. Silane gas ($SiH_4$) is used as reactive gas. An amorphous silicon film of n-type conductivity is formed by adding phosphine gas ($PH_3$) as dopant, and an amorphous silicon film of p-type conductivity is formed by adding diborane gas ($B_2H_6$) as dopant. An i-type amorphous silicon film may be formed without adding any dopant.

The thickness of the p-type film, and the n-type film, respectively, ranges from 50 to 100 nm, and the thickness of the i-type film ranges from 50 to 300 nm.

The solar battery layer composed of the amorphous silicon films of p-i-n junction can be formed continuously with the plasma chemical vapor deposition system.

Then, a transparent electrode film (not shown) is formed on the surface of the solar battery layer by use of the sputtering system, thereby obtaining a solar battery 3. In forming the transparent electrode film, indium tin oxide (ITO) is used.

The metal mask may be used for forming the transparent electrode film on parts of the surface of the solar battery layer. The metal mask is prepared from a thin metal sheet and has openings in regions where the transparent electrode film is formed. The formation of the transparent electrode film within the openings of the metal film is carried out by placing the solar battery inside the sputtering system, where the layer of the solar battery is overlaid with the metal mask having the openings.

A method of fabricating the dial 4 formed by molding ceramic containing alumina as a main constituent is described hereafter.

Firstly, a mold is filled up with a mixture of a ceramic material containing alumina as a main constituent, and a binder. In this case, alumina in powder form of about 0.3 μm in grain diameter is used, and an amount of the binder added represents about 3.0% of the mixture.

For the ceramic material, alumina at purity of 99.5% or higher is used, and for the binder, polyvinyl alcohol (PVA) is used.

In the case of the ceramic material of alumina at a purity less than 99.5% being used, the dial 4 was found tinted with the color of impurities, significantly reducing declining its light transmittance. Therefore, it is preferable to use the ceramic material of high purity alumina at 99.5% or higher for fabricating the dial 4 for a desirable white appearance.

Then, a pressurizing process is applied to the mold filled up with the mixture of the ceramic material and the binder. At this time, pressure of about 1 ton/cm$^2$ is applied to the mold.

Hereupon, as shown in FIG. 2, the dial 4 has projecting parts 4*a* and 4*b*, a display window 4*c* for displaying dates and days of the week, and a center hole 4*d* through which a spindle of the second hand protrudes from a movement of the watch.

Subsequently, a first sintering process is applied to the dial 4, removing the binder composed of PVA which was added to the ceramic material. The first sintering process is applied in the atmosphere at a temperature in the range of about 800° to 1600° C. for a duration of about 120 minutes. As a result of the first sintering process applied, the dial 4 shrinks slightly in its outer dimensions because the binder is removed, but undergoes little change in the thickness thereof.

Thereafter, a second sintering process is applied at a temperature higher than that for the first sintering process. The second sintering process is applied at a temperature (1500° to 1900° C.) close to the fusion point of ceramic for a duration of about 300 minutes. The second sintering process is applied in a vacuum to increase the density of the ceramic.

The second sintering process applied at a temperature close to the fusion point of the ceramic as described above is conductive to progress in crystallization. Consequently, the diameter of the ceramic grains in the final stage of the steps is much larger than 0.3 μm.

By means of such a step of enlarging the diameter of the ceramic grains as described above (crystallization step), light transmittance of the ceramic can be enhanced. The enhanced light transmittance of the dial 4 permits a sufficient amount of light to be transmitted to the solar battery 3, which is quite desirable from the viewpoint of securing enough generated power necessary as a source of power supply to the watch.

However, it has been found as a result of various studies that the step of enlarging the diameter of the ceramic grains applied excessively results in excessive transparency of the dial 4 due to a decrease in a amount of light scattered inside the ceramic. When the dial 4 becomes excessively transparent, it can not fulfill its function as a covering member to cause the solar battery to be unrecognizable from the outside.

In this embodiment, a preferable diameter of the ceramic grains in forming the dial 4 will be described later. However, prior to this description, steps to be taken upon completion of the second sintering process will be first described.

Upon completion of the second sintering process, the surface of the dial 4 is flattened by removing undulation thereof by use of a grinder. There are various methods of grinding, for example, simultaneous grinding of both faces, grinding of one face by pasting the ceramic on a working jig using wax, and the like. For grinding, diamond powders and a diamond grinder are used.

As for the size of a workpiece in grinding, it is preferable to adopt a thickness in the order of 0.4 mm. Normally, the thickness of the workpiece when the pressurizing process thereof in the mold is completed may be preferably thicker by about 0.3 mm than that of the finished dial 4.

Then, a third sintering process is applied to the ceramic at a temperature (1200° to 1600° C.) lower than that for the second sintering process for a duration of about 120 minutes. By applying the third sintering process in the atmosphere, dirt adhered to the surface of the ceramic is removed through oxidation reaction, and the like.

Then, barrel polishing is applied to the dial 4 by use of a barrel polishing apparatus. In such barrel polishing, balls made of copper (Cu) may be used. As a result of the barrel polishing, the surface roughness of the dial 4 is reduced thereby, enhancing the light transmittance of the dial 4. Furthermore, the barrel polishing enables burrs generated around the outer rim and in the corners of the dial 4 to be removed and in addition, roundness to be provided in the corners of the dial 4.

Thereafter, a fourth sintering process is applied to the ceramic at a temperature (1200° to 1600° C.) lower than that for the second sintering process for a duration of about 120 minutes. The fourth sintering process is also applied in the atmosphere for cleaning up the surface of the ceramic by further removing dirt adhered to the surface. Normally, the third and fourth sintering processes may be applied under the same condition.

Finally, indicators, lettering for a brand name and the like, graphic, a symbol (dial patterns) are inscribed on the surface of the dial 4 by a printing method to complete the dial 4.

In case that undulation on the surface of the ceramic, and fluctuation in the thickness thereof can be minimized in the course of the pressurization process of the ceramic using the mold, and the first and second sintering processes thereof, the grinding and the third sintering processes to be applied thereafter may be omitted.

The inventors of this application fabricated samples (A to M) of the dial 4 by use of the method of fabrication under varying conditions. FIG. 3 shows fabricating conditions of the samples, and measurement results of samples including average diameters of ceramic grains of the samples, light transmittance of respective samples, and transparency of the same.

Alumina used in fabrication of the samples was 99.9% pure, and the thickness of the samples (A to M) of the dial was 0.4 mm. As a result of the second sintering process applied in vacuum, the ceramic of each of the samples acquired high density in the range of 3.90 to 3.92 g/cm$^3$.

The average diameters of the ceramic grains were measured through observation of the cleaved surfaces of the samples using an electron microscope. The light transmittances of the samples were determined by measuring a power output value of the solar battery 3 when the samples (A to M) of the dial were placed on the solar battery 3. Herein, the light transmittance was determined as 100% when a power output value of the solar battery 3 without the samples (A to M) of the dial placed thereon was obtained.

Further, transparency of the samples (A to M) of the dial was determined by visual observation therethrough on the basis whether or not two black lines drawn in parallel at a spacing of 0.3 mm can be separably identified. Some of the samples, through which such identification was achieved, are marked with blank circles while other samples are marked with crosses. The spacing of 0.3 mm between the two black lines corresponds to the size of smallest letters normally inscribed on the dial of a watch.

As is evident from the measurement results shown in FIG. 3, when the average diameter of the ceramic grains is 45 μm or greater, the transparency of the dial samples increases excessively, significantly reducing the dial's performance to cover the solar battery 3. The results of a survey made on sensuous impression of a plurality of subjects actually inspecting a solar battery powered watch fabricated according to the structure shown in FIG. 1 indicate that the criteria for assessing the transparency, adopted by the inventors of the invention, substantially agree with the subjects' sensuous perception on the transparency.

It has been found from the measurement results described above that the average diameter of the ceramic grains need be preferably kept at about 40 μm or less for the dial 4 to permit a maximum amount of light irradiating the solar battery 3 to be transmitted therethrough, and yet to cover sufficiently the solar battery 3.

On the other hand, it has become apparent that when the average diameter of the ceramic grains becomes less than 5 μm, the light transmittance of the dial declines sharply. Accordingly, it can be stated that the average diameter of the ceramic grains need be preferably kept in the range from 5 μm to 40 μm for the dial 4 to obtain whiteness while permitting the solar battery 3 to maintain a necessary power generation capability.

Further, the thickness of the dial 4 is preferably kept in the range between 0.2 mm and 0.5 mm because impact resistance thereof deteriorates when the thickness becomes less than 0.2 mm. On the other hand, when the thickness is greater than 0.5 mm, the watch itself becomes excessively thick, depreciating the commercial value thereof. However, from the viewpoint of strength, the dial 4 with the critical thickness of 0.1 mm at the minimum can be put to practical use.

Reviewing again the measurement results shown in FIG. 3 while taking into account such constraint as described above in respect of the thickness of the dial 4, it can be stated that, as the dial 4 became thinner by 0.1 mm, the light transmittance thereof increased by about 1.5%, but that the transparency thereof did not undergo noticeable change.

Therefore, it is appropriate to state that the average diameter of the ceramic grains should be preferably in the range from 5 μm to 40 μm regardless of the thickness of the dial 4 provided that the thickness thereof is in the range between 0.1 mm and 0.5 mm.

Further, it is readily understood on the basis of the measurement results shown in FIG. 3 that the average diameter of the ceramic grains can the controlled by regulating sintering temperatures, the duration of sintering, sintering atmosphere, and the like.

When the dial 4 fabrIcated under the adequate conditions described above was incorporated in the solar battery powered watch having the structure shown in FIG. 1, the watch was found to continue moving normally without stopping due to shortage of generated electric power. Furthermore, the dial 4 was natural white in color.

(Second Embodiment)

A solar battery powered watch according to a second embodiment will be now described.

The feature of the second embodiment resides in a structure of dial patterns which are formed on the surface of a dial (covering member) 4 of the solar battery powered watch shown in FIG. 1. The other entire structure and the method of fabricating the solar battery, and the method of fabricating the dial are the same as those of the first embodiment (see FIG. 1), and hence the detailed explanations thereof are omitted while numerals in figures are denoted in common with those of the first embodiment.

Figure 4:
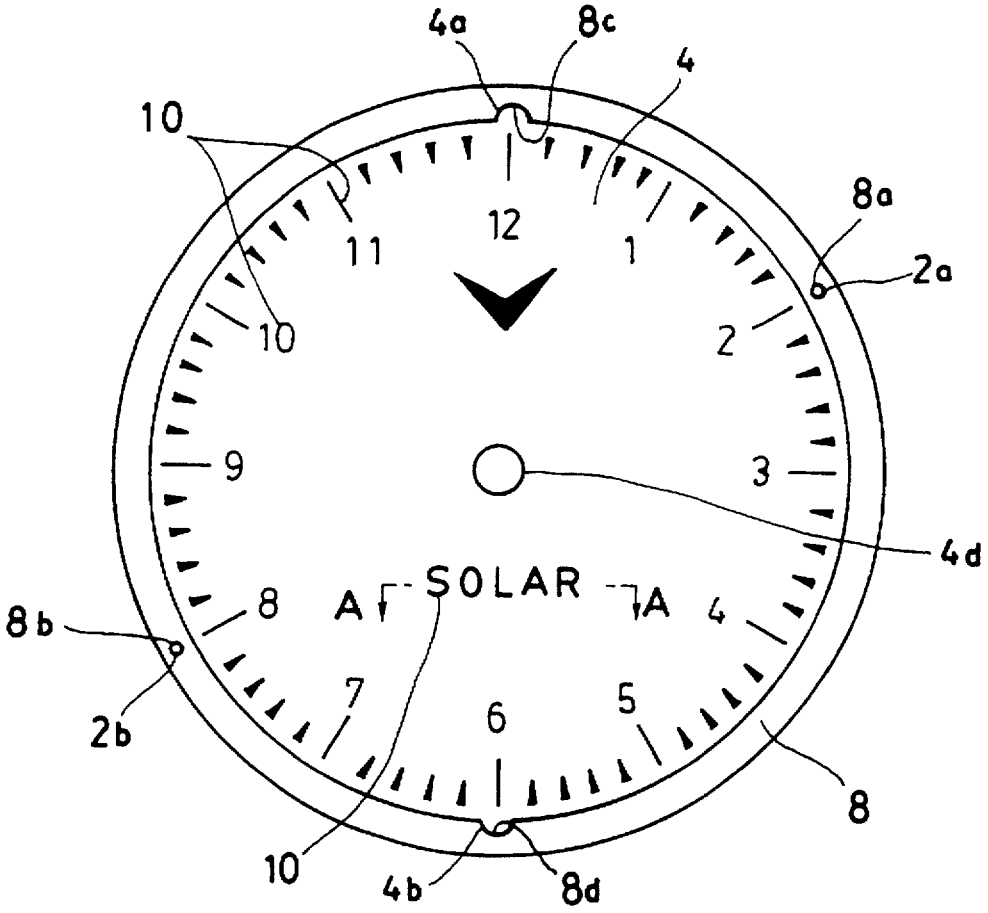
FIG. 4 is a plan view of a dial (covering member) of a solar battery powered watch according to a second embodiment of this invention.
Figure 5:
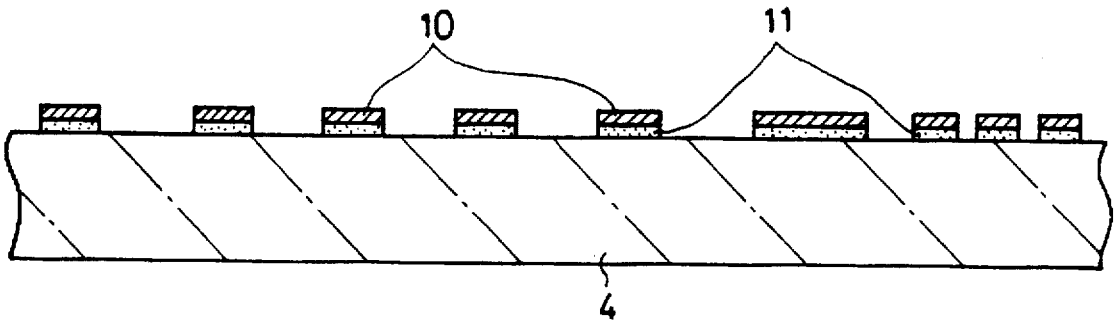
FIG. 5 is a cross sectional view taken along the line A—A of FIG. 4.

FIG. 4 is a plan view of a front surface of the dial, and FIG. 5 is a cross sectional view taken along the line A—A in FIG. 4.

As shown in FIG. 4, dial patterns 10 such as indicators, lettering for a brand name and the like, graphic, a symbol are inscribed on the surface of the dial 4.

As shown in FIG. 5, light reflection layers 11 are interposed between the surface of the dial 4 and the dial patterns 10. The light reflection layers 11 are formed by masking the surface of the dial 4, then applying a vacuum evaporation to a thin metal film such as aluminum, nickel, and the like or etching the thin metal film formed on the entire surface of the dial 4 in the form of the dial patterns 10. After the light reflection layers 11 were formed, the dial patterns 10 may be printed on the surface of the light reflection layers 11. Further, the dial patterns 10 may be printed using ink in which fine particles of gold or aluminum is dispersed, then heat drying or high temperature sintering process is applied to the dial patterns 10 so as to form the light reflection layers 11.

The effect of the formation of the light reflection layers 11 will be now described with reference to FIGS. 6 through 8.

Figure 6:
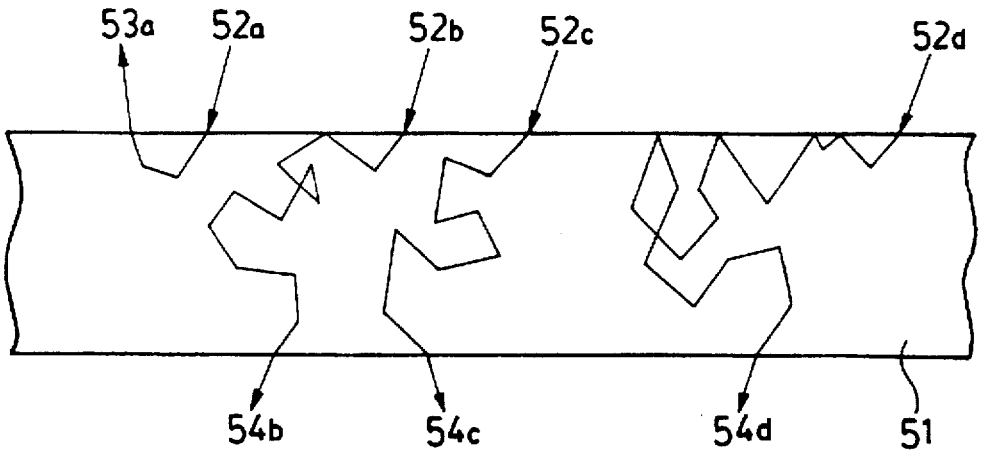
FIGS. 6 through 9 are cross sectional views for explaining function and effect of the solar battery powered watch according to the second embodiment of this invention.

FIG. 6 schematically shows lights 52*a*, 52*b*, 52*c*, 52*d* which are respectively incident to a substrate 51 having light transmittance and light diffusibility. The light diffusibility of the substrate 51 appears because of the diffusion of light inside the substrate 51. In FIG. 6, the light diffusibility is illustrated as sharp change of directions of the lights inside the substrate 51. Such diffusing phenomenon is caused by discontinuity of refractive index at interfaces between fine particles.

When the lights are changed in directions, a part of the lights, such as a light 53*a* is emitted outside from the surface of the substrate 51. This is phenomenally similar to the surface reflection. Other lights such as the lights 54*b*, 54*c* and 54*d* are emitted from the back surface of the substrate 51, and they are transmitted lights.

Although FIG. 6 schematically shows a light by a single line, it is noted that for example, the entire incident light 52*d* does not necessarily form the optical path denoted by the line shown in FIG. 6 to be emitted but a part of the light 52*d* is emitted, because there actually occurs diffusion of light inside the substrate 51 with a certain probability. However, the following typical expression is sufficient for explaining the light, and the probability problem is not referred to in this explanation.

Figure 7:
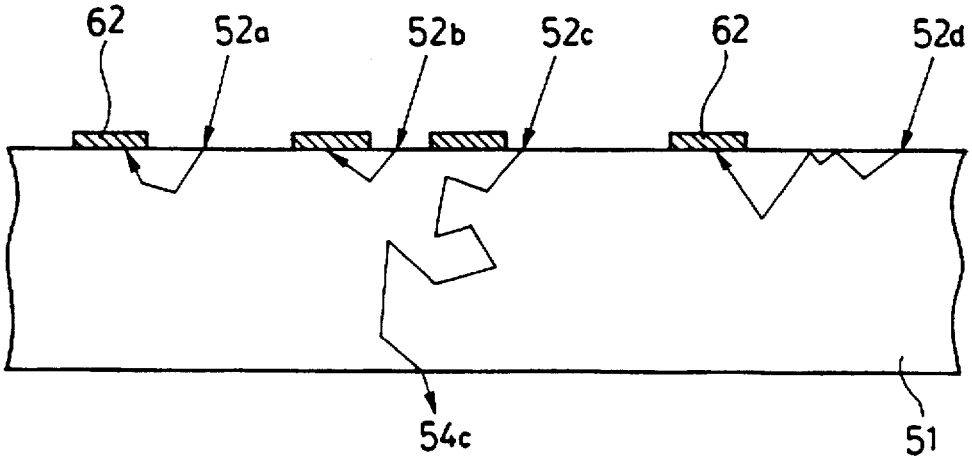

FIG. 7 shows light absorption bodies 62 formed at a part of the surface (incident side) of the substrate 51 in addition to the structure of FIG. 6.

In FIG. 7, supposing that the lights 52*a*, 52*b*, 52*c* and 52*d* shown in FIG. 6 respectively form the optical paths inside the substrate 51 like the case of FIG. 6, the lights 52*a*, 52*b* and 52*d* which travel along the surface of the substrate 51 are respectively absorbed by the light absorption bodies 62 as evident from FIG. 7 in the midway of the respective optical paths, then they are finally changed to heat.

That is, in the structure of FIG. 7, the lights are not emitted from the substrate 51 like the lights 54*b*, 54*c* and 54*d* as shown in FIG. 6. However, the light incident to the substrate 51 as the light 52*c* does not meet the light absorption bodies 62 in the course of traveling so that it is emitted from the back surface of the substrate 51 as the light 54*c* like the case of FIG. 6.

Figure 8:
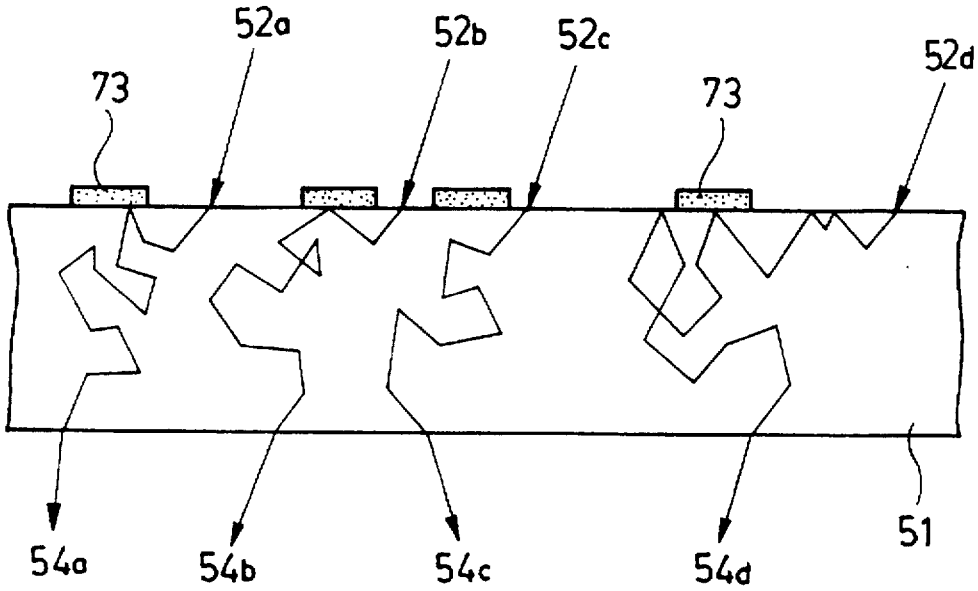

FIG. 8 shows light reflection bodies 73 each made of a metallic material and replaced with the light absorption bodies 62 of FIG. 7.

Supposing the lights 52*a*, 52*b*, 52*c* and 52*d* shown in FIG. 6 respectively form the optical paths inside the substrate 51 like the case of FIG. 6, lights incident from the inside of the substrate 51 to the light reflection bodies 73 are reflected substantially 100% and are returned to the inside of the substrate 51. Accordingly, the lights which are incident as the lights 52*a*, 52*b*, 52*c* and 52*d* are respectively emitted from the back surface of the substrate 51 as the lights 54*a*, 54*b*, 54*c* and 54*d*.

As for the light 54*a*, although it is emitted from the back surface of the substrate 51, there is good possibility that it is emitted from the front surface of the substrate 51 depending on the course of diffusion inside the substrate 51.

Let us consider as follows by applying the above explanation of the principle to the solar battery powered watch of the second embodiment of this invention.

The dial 4 shown in FIG. 5 corresponds to the substrate 51 shown in FIGS. 6 through 8. When the dial patterns 10 are directly formed on the surface of the dial 4 (without interposing the light reflection layers 11), the dial patterns 10 correspond to the light absorption bodies 62 of FIG. 7, from which it is evident that light absorption phenomenon as explained in FIG. 7 will occur.

Meanwhile, in the second embodiment in which the dial patterns 10 are formed on the surface of the dial 4 by way of the light reflection layers 11 (see FIG. 5), the light reflection layers 11 correspond to the light reflection bodies 73 of FIG. 8 from which it is understood that the light reflection phenomenon as explained in FIG. 8 will occur.

As is evident from the above explanations, in the structure including the dial patterns 10 which are formed on the dial 4 having light transmittance and light diffusibility without interposing the light reflection layers 11, a part of the incident lights is absorbed by the dial patterns 10 and it is attenuated.

On the other hand, according to the second embodiment having the light reflection layers 11, most of lights which are incident to the dial 4 can transmit to the back surface of the substrate 51 without being attenuated. That is, it is possible to eliminate loss of light caused by absorption of light at the interface between the dial 4 and the dial patterns 10, and also it is possible to reduce the amount of light irradiating the solar battery 3 to a minimum.

Particularly, a part of the lights, which is incident to the dial 4 at the peripheries of the dial patterns 10 and is diffused horizontally, is easily absorbed by the dial patterns 10, so that the amount of light reaching the solar battery is further attenuated by the amount corresponding to several times as large as that of an area ratio (normally about 5%) of the dial patterns 10 relative to the dial 4, thereby exerting an non-negligible influence upon the solar battery powered watch provided with the solar battery 3. The light reflection layers 11 provided in the second embodiment performs such function and effect that they suppress the attenuation of the amount of transmitted light, and increase the amount of light irradiating the solar battery 3.

Figure 9:
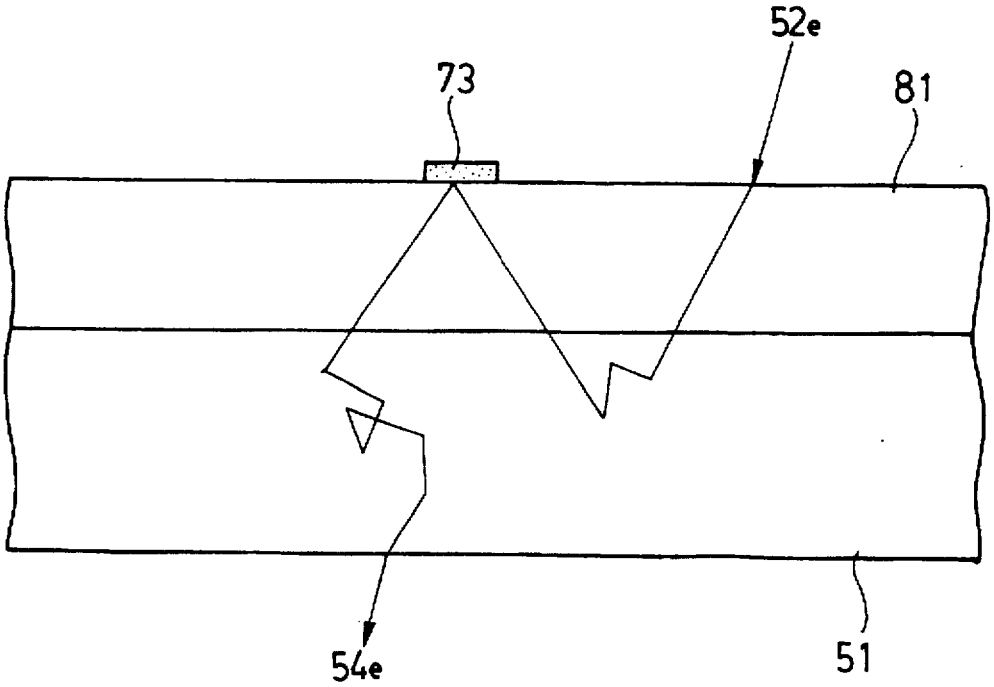

FIG. 9 is a view of a solar battery powered watch according to another modification of the second embodiment.

That is, a transparent substrate 81 is provided in addition to the constituent of FIG. 8, and the light reflection body 73 is formed on the front surface of the transparent substrate 81. An incident light 52*e*, shown as an example, travels directly inside the transparent substrate 81, and is diffused inside the substrate 51, then it is returned to the transparent substrate 81, then it travels directly inside the transparent substrate 81, and then it is reflected on the light reflection body 73. Thereafter, the incident light 52*e* travels directly inside the transparent substrate 81, and is diffused inside the substrate 51, and finally it is emitted from the back surface of the substrate 51 as the emitted light 54*e*.

Incidentally, since only the substrate 51 has light diffusibility, the transparent substrate 81 plays a role to permit the light to directly travel therein.

When the structure shown in FIG. 9 is applied to the dial 4, a transparent substrate having direct light traveling property is laminated to the surface of the substrate 51 made of ceramic, and the dial patterns 10 are formed on the surface of the transparent substrate by way of the light reflection layers 11. Even in such a structure, it is possible to prevent light from being absorbed by the dial patterns so that the light can sufficiently irradiate the solar battery 3. Further, such a change of structure has an effect that a free designing of the dial for the solar battery powered watch can be enhanced.

Next, a method of forming the light reflection layers 11 and the dial patterns 10 on the dial 4 will be described in detail.

After the dial 4 was fabricated by the method of fabricating the dial, which was explained in the first embodiment, the light reflection layers 11 are formed on the surface of the dial 4.

That is, the light reflection layers 11 are formed on the dial patterns 10 using ink composed of powdered gold which is dispersed in and mixed with varnish by a tampon printing method. Thereafter, the light reflection layers 11 are temporally dried at the temperature of about 100° C., further it is sintered by a heat of about 750° C. so that only gold is sintered to form the light reflection layers 11.

Finally the tampon printing is applied to the surface of the light reflection layers 11 using UV hardening type ink of black pigment, and it is temporally dried at the temperature of about 80° C., then it is irradiated with UV rays to completely solidify the light reflection layers 11.

The dial 4 which was fabricated with the above steps is incorporated into the case 1 shown in FIG. 1. As a result, inoperative condition such as stop of the watch which will be caused by the shortage of generated electric power of the solar battery 3 does not occur, and the watch remains operative normally. Furthermore, the dial was natural white in color.

The area ratio of the dial patterns 10 relative to the dial 4 is 4.3%, and the light transmittance of the dial 4 is 51% before the light reflection layers 11 and the dial patterns 10 are formed, and it is 49% after the light reflection layers 11 and the dial patterns 10 were formed.

As for the dial as a comparative example, which was fabricated by omitting the printing step using ink composed of powdered gold which is dispersed in and mixed with varnish among the aforementioned steps, the light transmittance is 51% before the dial patterns are formed and it is 42% after the dial patterns were formed.

Although in the second embodiment set forth above, the light reflection layers 11 are interposed between the dial 4 and the dial patterns 10, the back surfaces of the dial patterns (surfaces contacting the dial 4) become the light reflection faces if the dial patterns 10 per se are formed of the light reflective material. Even such light reflection faces can reflect the scattered light inside the dial 4 to the solar battery 3, so that they can achieve the same effect as the light reflection layers 11.

(Third Embodiment)

A solar battery powered watch according to a third embodiment of this invention will be now described.

The feature of the third embodiment resides in fixing means of the dial 4 (covering member) in the case 1 and positioning means relative to the movement 2 in the solar battery powered watch shown in FIG. 1. The other entire structure and the method of fabricating the solar battery, and the method of fabricating the dial are the same as those of the first embodiment (see FIG. 1), and hence the detailed explanations thereof are omitted while numerals in figures are denoted in common with those of the first embodiment.

Figure 10:
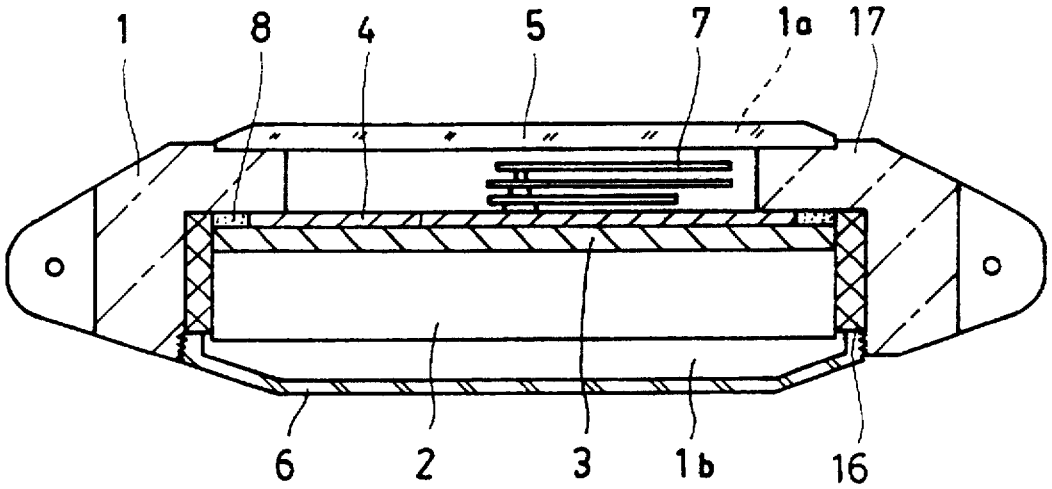
FIG. 10 is a cross sectional view of a solar battery powered watch according to a third embodiment of this invention.
Figure 11:
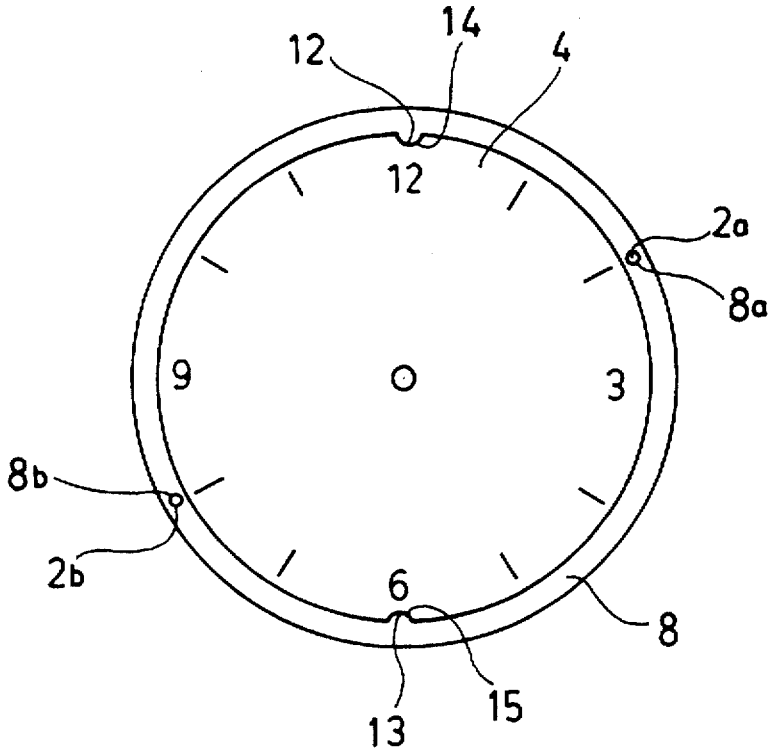
FIG. 11 is a plan view of a covering member which is one of the constituents of the solar battery powered watch of the third embodiment and is used as a dial.

FIG. 10 is a cross sectional view of the solar battery powered watch according to the third embodiment, and FIG. 11 is a plan view of a dial (covering member) and a positioning frame which are respectively constituents of the solar battery powered watch.

As shown in FIG. 11, recessed parts 12 and 13 each having a circular shape or a rectangular shape are provided on the dial 4 at positions close to the dial patterns 10 which indicate twelve o'clock and six o'clock. Meanwhile, projecting parts 14 and 15 which are engaged in the recessed parts 12 and 13 are formed in the positioning frame 8.

The positioning frame 8 is made of a resin material or a metallic material, and it is arranged on the upper surface of the solar battery 3 at the outer periphery of the dial 4. The positioning holes 8*a* and 8*b* are respectively bored in the positioning frame 8 while the positioning pins 2*a* and 2*b* are respectively provided on the front face of the movement 2 at the outer periphery thereof. The positioning pins 2*a* and 2*b* penetrate the solar battery 3 and protrude to the surface of the solar battery 3. The positioning frame 8 can be positioned relative to the movement 2.

If the dial 4 is arranged in a state where the projecting parts 14 and 15 are engaged in the recessed parts 12 and 13, the dial 4 can be positioned relative to the movement 2 by way of the positioning frame 8.

Meanwhile, the surfaces of the dial 4 and the positioning frame 8 are flush with each other, and the surface of the positioning frame 8 which contacts the case 1 is flush with the case 1 awhile the dial 4 and the positioning frame 8 are aligned with each other in height.

The movement 2, the solar battery 3 and the outer periphery of the positioning frame 8 are respectively held by a frame body 16 and they are accommodated in the case 1 while keeping this holding state. When the frame body 16 is pressed against the face side opening 1*a* of the case 1 by the case back 6, the positioning frame 8 and the dial 4 contact a peripheral sidewall 17 of the face side opening 1*a* of the case 1.

If the state where the dial 4 and the positioning frame 8 contact the peripheral sidewall 17 of the case 1 is maintained, there is no likelihood of breakage of the dial 4 and the positioning frame 8 caused by striking against the peripheral sidewall 17 even if they receive a large impact loading, thereby enhancing the impact tolerance.

As compared with the case where the projecting parts 4*a* and 4*b* shown in FIG. 2 are formed on the dial 4 made of a fragile material such as ceramic and they are engaged in the recessed parts 8*c* and 8*d* of the positioning frame 8, the recessed parts 12 and 13 are provided on the dial 4 so that the stress concentration occurs in the projecting parts 4*a* and 4*b*, thereby preventing the dial 4 from being cracked and broken, and further enhancing the impact tolerance.

Figure 12:
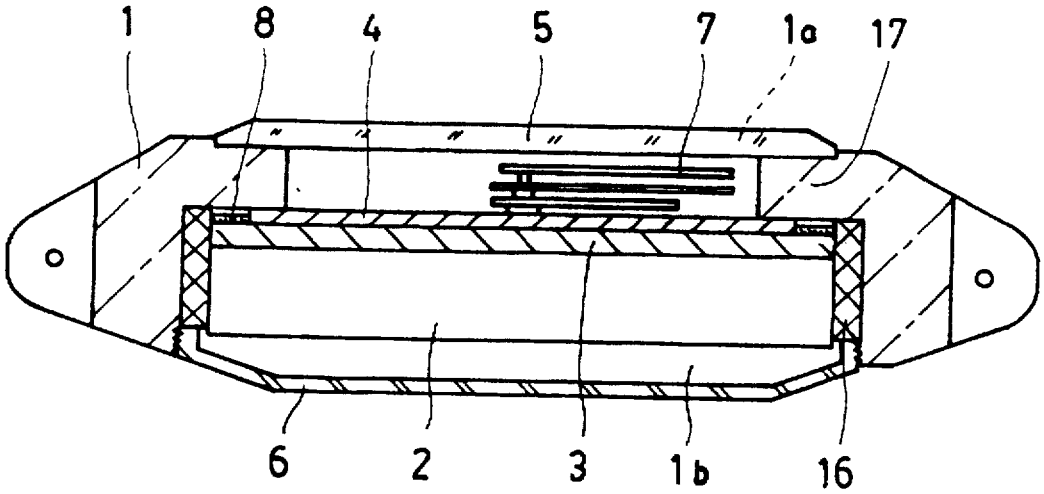
FIG. 12 is a cross sectional view of the solar battery powered watch according to a modification of the third embodiment of this invention.

FIG. 12 is a cross sectional view of a modification of the third embodiment.

In this embodiment, only the dial 4 contacts the peripheral sidewall 17 of the face side opening 1*a* of the case 1, and a gap is defined between the positioning frame 8 and the peripheral sidewall 17. That is, the height of the positioning frame 8 is set to be lower than that of the dial 4.

When the positioning frame 8 is made of a metallic material which is less fragile the same impact tolerance can be obtained in the same way as the third embodiment.

Figure 13:
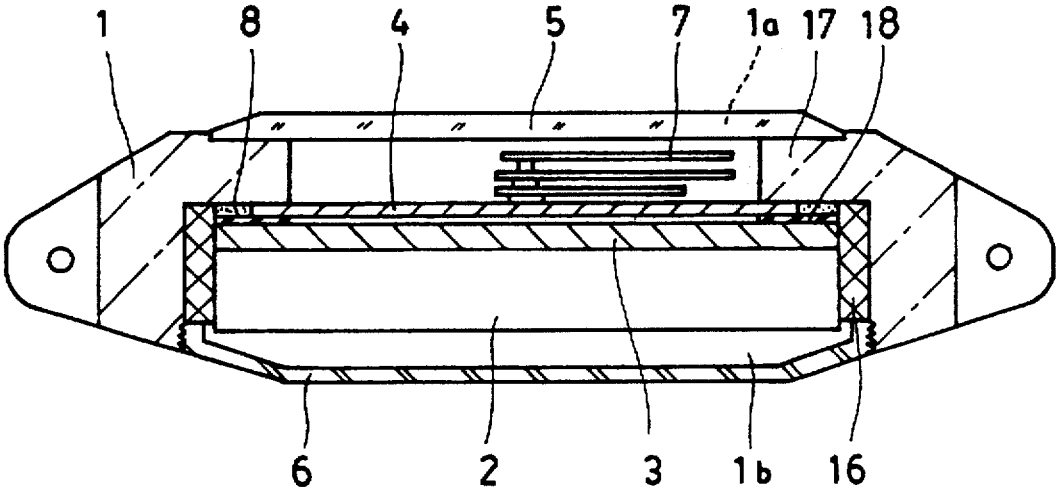
FIG. 13 is a cross sectional view of the solar battery powered watch according to another modification of the third embodiment of this invention.

FIG. 13 is a cross sectional view of another modification of the third embodiment.

In this modification, an elastic member 18 is provided between the dial 4, the positioning frame 8 and the solar battery 3. The elastic member 18 is made of rubber or synthetic resin respectively having elasticity, and it has a thickness ranging from 50 to 100 μm. Since the elastic member 18 is interposed as set forth above, it is possible to prevent a mechanical breakage caused by the striking of the dial 4 and the positioning frame 8 against the light receiving surface 3*a* of the solar battery 3 and possible to enhance the impact tolerance of the dial 4 owing to an impact or shock absorbing effect by the elastic member 18.

The elastic member 18 may be provided between the dial 4, the positioning frame 8 and the solar battery 3 in the structure of the modification in FIG. 12.

As a result of impact tests for the solar battery powered watch having the structures shown in FIGS. 10, 11 and 12 which test corresponds to a free drop of watch from the height of 1 m, the dial 4 is not at all broken.

In the positioning structure of the dial 4 shown in FIG. 11, the recessed parts 12 and 13, and the projecting parts 14 and 15 may be provided appropriately at three points or more on the dial 4.

(Fourth Embodiment)

Figure 14:
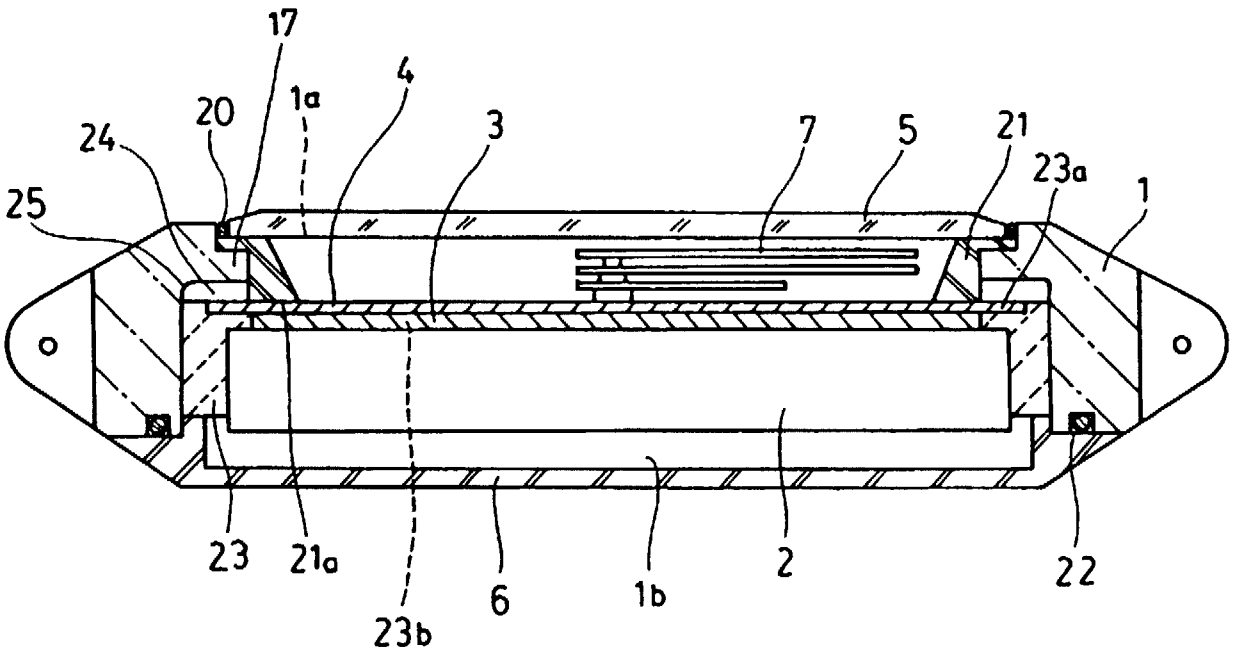
FIG. 14 is a cross sectional view of a solar battery powered watch according to a fourth embodiment of this invention.

A solar battery powered watch according to a fourth embodiment of this invention will be now described with reference to FIGS. 14 and 15. FIG. 14 is a cross sectional view of the solar battery powered watch of the fourth embodiment, and FIG. 15 is a plan view of a covering member which is one of the constituents of the solar battery powered watch and is used as a dial.

Figure 15:
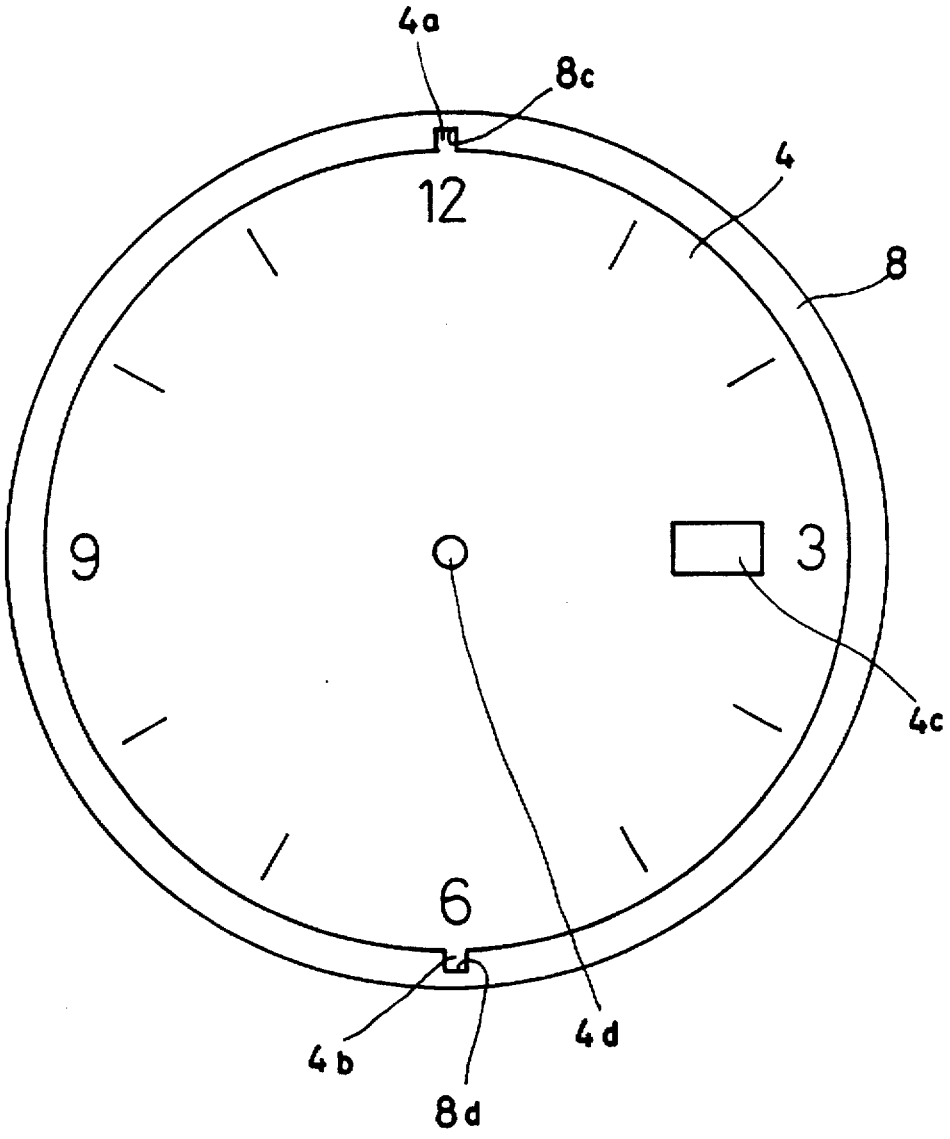
FIG. 15 is a plan view of a covering member which is one of the constituents of the solar battery powered watch of the fourth embodiment and is used as a dial.

In FIGS. 14 and 15, constituents which are the same as or correspond to those in FIGS. 1 and 2 are denoted by the same numerals, and the explanations thereof are omitted.

The glass 5 is attached to the face side opening 1*a* of the case 1 by way of a first packing 20 made of a resin material, thereby forming an airtight structure to prevent the entry of dust, moisture and the like to the solar battery powered watch.

The ornamental frame 21 is fixed to the inner side of the case 1 along the periphery of the face side opening 1*a* of the case 1. The ornamental frame 21 covers the periphery (rough surface) of the face side opening 1*a* of the case 1 which is a forged product, and it has been conventionally employed for enhancing the ornamental value of the watch. The ornamental frame 21 is generally made of a material which is different from that of the case 1, and it has a mirror-finished surface formed by grinding the surface thereof by a diamond tool.

Further, a groove is defined in the case 1 at the surface to which the case back 6 is attached, and a second packing 22 made of a rubber material is provided in the groove. The case back 6 is mounted to the case 1 by way of the second packing 22, thereby forming an airtight structure to prevent the entry of dust, moisture and the like to the solar battery powered watch.

The movement 2, the dial 4 and the solar battery 3 are accommodated in the case 1 in the state where they are held by a casing frame 23 at the outer peripheries thereof. The casing frame 23 is made of a resin material. A stage part 23*a* having the same dimensions as the thickness of dial 4 is formed on the stage part 23*a* at the front end thereof, wherein the dial 4 which is engaged in the positioning frame 8 (see FIG. 15) is accommodated in the stage part 23*a* to be dropped therein. Accordingly, the front end of the casing frame 23 is flush with the surface of the dial 4.

An accommodation part 23*b* of the solar battery 3 is defined in the casing frame 23 under the stage part 23*a* for accommodating the dial 4 therein. The solar battery 3 is arranged in the accommodation part 23*b*.

The lower end surface 21*a* of the ornamental frame 21 protrudes under (the back side of) the peripheral sidewall 17 of the face side opening 1*a* of the case 1 shown in FIG. 14. Accordingly, the casing frame 23 for holding the dial 4, the solar battery 3 and the movement 2 is pressed by the case back 6 from the back side, the inner face of the periphery of the dial 4 is brought into contact with the ornamental frame 21.

At this time, if the lower end surface 21*a* of the ornamental frame 21 is positioned under (the back side of) a curved part 25 which is formed by a forging process on the base of the peripheral sidewall 17, the casing frame 23 is not liable to interfere with the curved part 25. When the dial 4 contacts the ornamental frame 21, a gap 24 is defined between the back of the peripheral sidewall 17 of the case 1 and the dial 4. Since the curved part with a thickness of about 0.2 mm is formed with corners in a general forging process, if the gap 24 having a length of about 0.2 mm is defined between the back of the peripheral sidewall 17 of the case 1 and the dial 4, it is possible to prevent the interference between the curved part 25 and the casing frame 23.

Since the projecting parts 4*a* and 4*b* formed at the periphery of the dial 4 (see FIG. 15) are disposed in the gap 24, even if impact loading is applied from the outside, the projecting parts 4*a* and 4*b* do not strike against the case 1. Accordingly, there is no likelihood of occurrence of stress concentration in the projecting parts 4*a* and 4*b*, thereby preventing the dial 4 from being cracked and broken, and further enhancing the impact tolerance.

The inventors of this application fabricated 10 solar battery powered watches each having the structure shown in FIG. 14, and these solar battery powered watches are subject to a hammer impact test corresponding to a free drop from the height of 1 m. As a result of the test, no dial 4 was broken.

Figure 16:
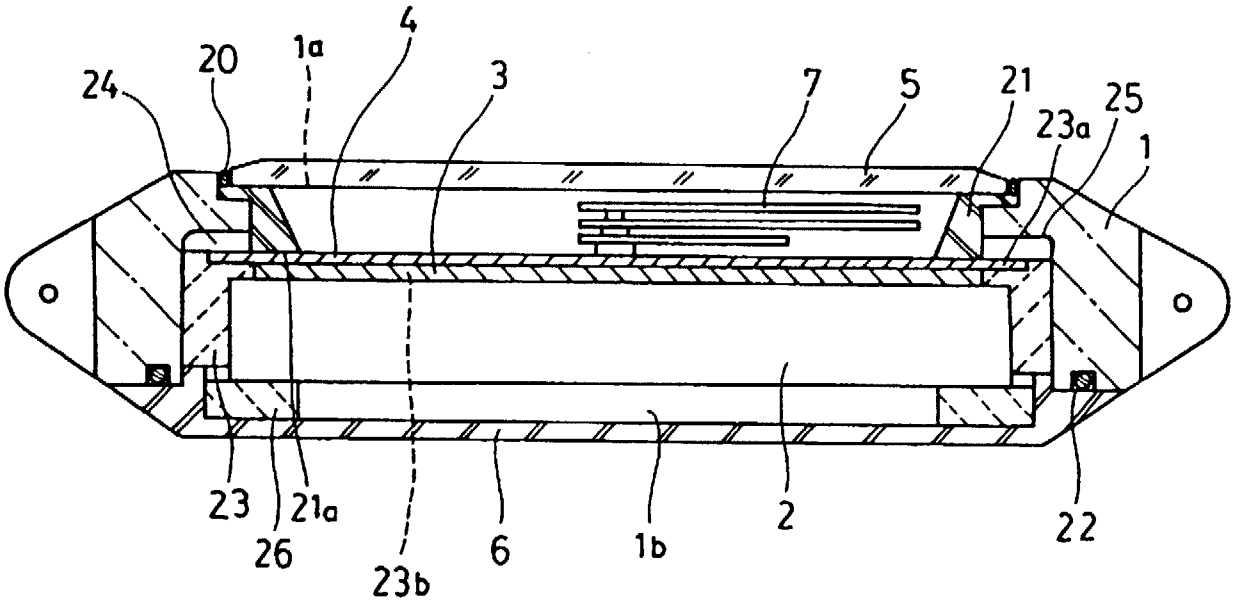
FIG. 16 is a cross sectional view of the solar battery powered watch according to a modification of the fourth embodiment of this invention.

FIG. 16 is a view for explaining a modification of the fourth embodiment.

The solar battery powered watch shown in FIG. 16 has an intermediate member 26 made of a resin material between the movement 2 and the case back 6. The intermediate member 26 may be fixed to the case back 6. It is preferable that the inner diameter of the intermediate member 26 is substantially the same as that of the ornamental frame 21 and the intermediate member 26 is opposite to the ornamental frame. With such an arrangement, a repulsive force which is generated between the ornamental frame 21 and the intermediate member 26 does not act on the constituents such as the movement 2, the solar battery 3 and the dial 4 as a shearing force.

Meanwhile, when the case back 6 is attached to the case 1, it is structured not to define a gap between the intermediate member 26 and the movement 2. In order to structure it as such, the thickness of the intermediate member 26 may be greater than the length of the gap between the movement 2 and the case back 6 by the length ranging from about 0.5 mm to 0.1 mm.

When the case back 6 is attached to the case 1, the dial 4 is brought into contact with and fixed to the ornamental frame 21 owing to the pressing force from the intermediate member 26. With the provision of the intermediate member 26, when solar battery powered watch receives the impact loading, the intermediate member 26 operates to suppress the deformation of the dial 4 to surely prevent the breakage of the dial 4.

Figure 17:
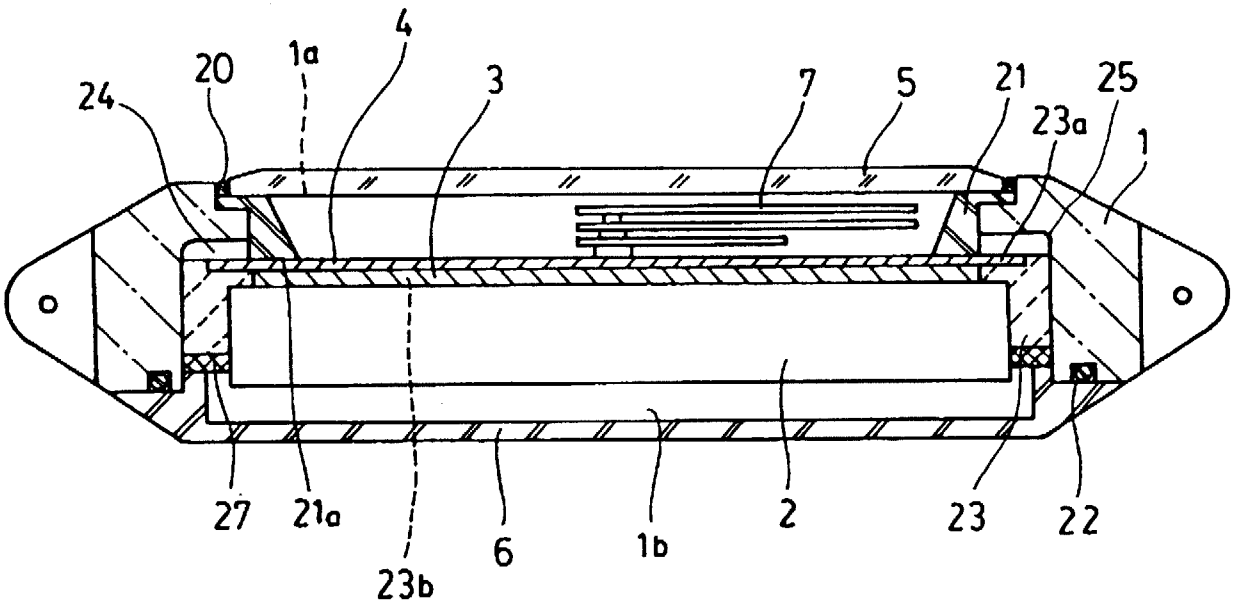
FIG. 17 is a cross sectional view of the solar battery powered watch according to another modification of the fourth embodiment of this invention.

FIG. 17 is a view for explaining another modification of the fourth embodiment.

The solar battery powered watch shown in FIG. 17 has an elastic member 27 such as rubber which is interposed between the casing frame 23 and the case back 6. The elastic member 27 may be fixed to the lower end surface of the casing flame 23. When the case back 6 is mounted to the case 1, the case back 6 is structured to press the elastic member 27, and the dial 4 is brought into contact with the ornamental frame 21 without generating a gap there between by the pressing force from the case back 6.

The operation of the elastic member 27 will be now described. That is, if the solar battery powered watch has not the elastic member 27, when it receives impact loading from the outside repetitively, the case back 6 made of the metallic material transmits the impact loading to the casing frame 23 repetitively. The casing frame 23 is made of a resin material as set forth above. Accordingly, the casing frame 23 is deformed when it receives the impact loading repetitively, so that a gap is defined between the casing frame 23 and the case back 6.

As a result, a gap is also defined between the surface of the dial 4 and the case 1 and between the case 1 and the ornamental frame 21. When the solar battery powered watch receives impact loading, the dial 4 strikes strong against the ornamental frame 21 so that the dial 4 is broken.

The elastic member 27 is provided as an impact absorbing member between the casing frame 23 and the case back 6 in order to prevent the deformation of the casing frame 23 caused by repetitive impact loading. When the elastic member 27 is provided, the deformation of the casing frame 23 owing to the impact loading is prevented, thereby preventing the breakage of the dial 4.

At though not shown in FIG. 17, the intermediate member 26 shown in FIG. 16 may be also provided between the case back 6 and the movement 2.

Figure 18:
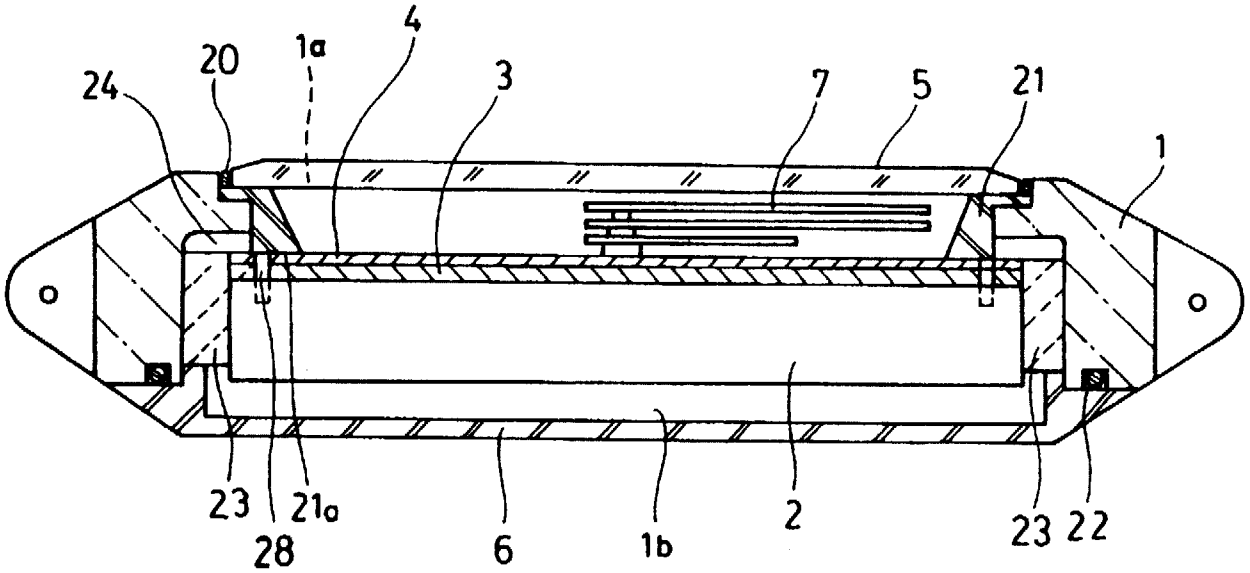
FIG. 18 is a cross sectional view of the solar battery powered watch according to still another modification of the fourth embodiment of this invention.

FIG. 18 is a view for explaining still another modification of the fourth embodiment.

The feature of the solar battery powered watch in FIG. 18 resides in a positioning fixed means for positioning and fixing the dial 4 relative to the movement 2. That is, in this modification, the projecting parts 4*a* and 4*b* are not formed on the dial 4 shown in FIG. 15, but a plurality of (e.g., two) through holes are bored in the dial 4 at a region contacting the ornamental frame 21 and end portions of fixed pins 28 are engaged in the through holes. The dial 4 is positioned relative to the movement 2 using the fixed pins 28.

Through holes through which the fixed pins 28 penetrate are bored in the solar battery 3, and positioning holes (fixing means) in which the fixed pins 28 are engaged are bored in the movement 2. The fixed pins 28 are engaged in the positioning holes of the movement 2 by way of the through holes of the solar battery 3, so that the dial 4 are positioned relative to and fixed to the movement 2, and the solar battery 3 is also positioned relative to the movement 2.

Although not shown in FIG. 18, the intermediate member 26 shown in FIG. 16 may be provided between the movement 2 and the case back 6. Further, the elastic member 27 shown in FIG. 17 may be provided between the case back 6 and the casing frame 23. Still further, the intermediate member 26 and the elastic member 27 are respectively provided.

Although the size of the dial 4 is substantially the same as that of the movement 2 in FIG. 18, these sizes are not necessarily the same. That is, the stage part 23*a* is formed on the casing frame 23 and the dial 4 is accommodated and disposed in the stage part 23*a* shown in FIG. 14.

Although the size of the dial 4 is substantially the same as that of the solar battery 3 in FIG. 18, the solar battery 3 may be made smaller than the dial 4 and it may be accommodated and disposed in the accommodation part 23*b* (see FIG. 14) of the casing frame 23. In this case, it is preferable that the dimensions of the solar battery 3 are substantially the same as or slightly greater than outer dimensions of the ornamental frame 21.

That is, when the solar battery powered watch receives the impact loading from the outside, the impact loading is transmitted to the dial 4 by way or the movement 2. At this time, when the dimensions of the solar battery 3 are smaller than the outer dimensions of the ornamental frame 21, a shearing force is applied to the dial 4 so that the dial 4 is liable to be broken. Accordingly, if the dimensions of the solar battery 3 are made larger than the outer dimensions of the ornamental frame 21, such a shearing force does not apply to the dial 4, thereby preventing the breakage of the dial 4.

As the fixed means for fixing the dial 4 and the solar battery 3 relative to the movement 2, it is possible to employ means other than the fixed pans 28 for adhering respective constituents, for example, an adhesive. In case that the solar battery 3 and the dial 4 are adhered to each other, it is possible to suppress the lowering of generated electric power of the solar battery 3 if only the periphery of the solar battery 3 is adhered by the adhesive.

In the aforementioned embodiments, the case 1 and the ornamental frame 21 are respectively formed of different members but they may as well be integrally formed.

CAPABILITY OF EXPLOITATION IN INDUSTRY

This invention can be utilized for various watches incorporating a solar battery therein as a power supply, thereby enhancing an ornamental value thereof and also enhancing light transmittance relative to the solar battery.

What is claimed is:

1. A solar battery powered watch comprising a case having an opening on a front side thereof, and a glass covering the opening, a movement having a hand-driving mechanism and housed in the case, a solar battery having a light receiving surface disposed opposite to the glass and installed on a front side of the movement inside the case, and a covering member for covering the light receiving surface of the solar battery, characterized in that the covering member is formed by molding ceramic containing alumina as a main constitute wherein an average diameter of the ceramic grains ranges from 5 μm to 40 μm, and the covering member is molded to a thickness ranging from 0.2 mm to 0.5 mm.

2. A solar battery powered watch comprising a case having an opening on a front side thereof, and a glass covering the opening, a movement having a hand-driving mechanism housed in the case, a solar battery having a light receiving surface disposed opposite to the glass and installed on a front side of the movement inside the case, and a covering member formed by molding ceramic for covering the light receiving surface of the solar battery;

characterized in that optional dial patterns are formed on a surface of the covering member, and light reflection layers or light reflection faces are interposed between the surface of the covering member and the dial patterns.

3. A solar battery powered watch, comprising a case having an opening on a front side thereof, and a glass covering the opening, a movement having a hand-driving mechanism housed in the case, a solar battery having a light receiving surface disposed opposite to the glass and installed on a front side of the movement inside the case, and a covering member formed by molding ceramic for covering the light receiving surface of the solar battery;

characterized in that a transparent substrate is laminated to the surface of the covering member, and optional dial patterns are formed on the surface of the transparent substrate, light reflection layers or light reflection faces being interposed between the surface of the transparent substrate and the dial patterns.

4. The solar battery powered watch according to claim 1, characterized in that an outer rim of the covering member is kept in contact with a peripheral sidewall of the opening of the case.

5. The solar battery powered watch according to claim 4, characterized in that:

a positioning frame disposed around the periphery of the covering member has projecting parts or recessed parts while the covering member has recessed parts or projecting parts for engagement with the projecting parts or the recessed parts of the positioning frame; and the watch further comprising a means for positioning the positioning frame relative to the movement.

6. The solar battery powered watch according to claim 1, characterized in that:

an ornamental frame is fixedly mounted inside the periphery of the opening of the case and inside of the periphery of the covering member is supported by the ornamental frame.

7. The solar battery powered watch according to claim 6, characterized in that:

a positioning frame is disposed around an outer periphery of the covering member, recessed parts are formed in the positioning frame, and projecting parts are formed in a periphery of the covering member for engagement with the recessed parts of the positioning frame; and a gap is defined between the periphery of the covering member and the case, and the projecting parts formed on the periphery of the covering member is disposed in the gap.

8. The solar battery powered watch according to claim 6, characterized in further comprising:

a backside opening formed on a back side of the case, a casing frame for securely holding the covering member, the solar battery, and the movement inside the case, and an intermediate member composed of a resin material, disposed opposite to the ornamental frame, and interposed between the case back cover and the movement without defining a gap therebetween.

9. The solar battery powered watch according to claim 6, characterized in that;

the case has a back side opening on a back side thereof; and a casing frame for securely holding the covering member, the solar battery, and the movement inside the case, and a case back cover for covering the back side opening, the case further comprising an elastic member interposed between the case back cover and the casing frames.

10. The solar battery powered watch according to claim 6, characterized in that:

through holes are defined in the covering member at a region contacting the ornamental frame, and end portions of fixed pins are engaged in the through holes, and the fixed pins protrude from the underside of the covering member, and through-holes are bored in the solar battery for insertion of the fixed pins, and further a means for securely holding the fixed pins is provided on the movement.

* * * * *